US007755504B1

(12) United States Patent
Garcia

(10) Patent No.: US 7,755,504 B1
(45) Date of Patent: Jul. 13, 2010

(54) APPLIANCE WARNING SYSTEM AND METHOD

(76) Inventor: Rodolfo Garcia, 2500 Wilshire Blvd., Suite 472, Los Angeles, CA (US) 90057

( * ) Notice: Subject to any disclaimer, the term of this patent is extended or adjusted under 35 U.S.C. 154(b) by 256 days.

(21) Appl. No.: 12/077,423

(22) Filed: Mar. 19, 2008

(51) Int. Cl.
*G08B 21/00* (2006.01)

(52) U.S. Cl. ..... 340/686.1; 340/500; 340/506; 340/522; 340/568.1; 219/445.1; 219/446.1

(58) Field of Classification Search ..... 340/686.1, 340/500, 506, 522, 568.1, 584, 588, 655, 340/309.3; 219/445.1, 446.1, 457.1, 481, 219/490
See application file for complete search history.

(56) References Cited

U.S. PATENT DOCUMENTS 4,577,181 A * 3/1986 Lipscher et al. ..... 340/522
5,901,961 A * 5/1999 Holland, III ..... 273/445
2008/0084296 A1* 4/2008 Kutzik et al. ..... 340/540

* cited by examiner

*Primary Examiner*—Hung T. Nguyen
(74) *Attorney, Agent, or Firm*—Colin P. Abrahams

(57) ABSTRACT

An appliance warning system comprises a floor pad for location adjacent an appliance such that a user must stand on the floor pad in order to normally use the appliance. The floor pad has at least one switch movable between an open position when no weight pressure is detected on the floor pad and a closed position when the switch is activated by weight pressure detected on the floor pad. A transmitter is provided for transmitting a signal depending upon whether the switch is in the open or closed position. A module is located remote from the floor pad, and has a receiver for receiving the signal from the transmitter, and a control circuit connected operational between a ready state before the switch is activated to the closed position and a monitoring state after the switch is activated to the closed position. A warning device connected to the control circuit is activated by the control circuit when in the monitoring state when the control circuit determines that the switch has been in the open position for a preselected period of time after having been in the closed position. A reset switch resets the control circuit from the monitoring state to the ready state.

20 Claims, 2 Drawing Sheets

APPLIANCE WARNING SYSTEM AND METHOD

FIELD AND BACKGROUND OF THE INVENTION

The present invention relates generally to an apparatus that alerts and warns a user of an appliance such as a stove or oven, either visually, audibly or by some other sensory means, that a cooking process has been initiated and requires monitoring and attention. Over a cyclic period of time the user, such as a cook, is signaled to return to the appliance and the cooking process, and hence to the source of combustion (i.e. the stove top burners, the oven, broiler, etc.) until the cooking process is completed or otherwise terminated. In this way, the risk of accidental damage which may arise due to overheating, combustion and possible kitchen fire due to an unattended cooking process is greatly reduced.

Every year, thousands of people are killed or injured in house fires. Some current statistics indicate that deaths from fires and burns are the fifth most common cause of unintentional injury and deaths in the United States and the third leading cause of fatal home injury. Sources indicate that in 2006 fire departments responded to 412,500 home fires in the United States, which claimed the lives of 2,580 people (not including firefighters) and injured another 12,925, not including firefighters. Some statistics and sources also indicate that 4 out of 5 fire deaths in 2005 occurred in residences and that cooking was the primary cause of these fires. Often, for example, cooking related fires are caused by unattended utensils which may be left on heating elements or gas flames. A common scenario involves an elderly person who initiates a cooking procedure and then forgets that food is cooking because of distractions such as a long telephone conversation; disease (Alzheimer's is an example), other impairment or just simple forgetfulness and absent-mindedness. Furthermore, unattended food left cooking on a burner may dry and overheat, and this scenario can lead to combustion and smoke. If cooking oil is involved, combustion can quickly result and produce an uncontrollable fire in very little time.

One solution to this problem is an inexpensive apparatus that (1) directly detects a person's or user's presence in front of a cooking appliance before a cooking procedure is initiated, (2) automatically monitors a user's attention to the cooking process, and (3) automatically warns with an alarm or other signal the user if the cooking process is left unattended.

Some U.S. patents which relate to safety devices in this area are mentioned below. Naugle (U.S. Pat. No. 4,255,669) describes a sensing apparatus for monitoring the operation of an electrical appliance. Nashawaty (U.S. Pat. No. 4,446,455) describes an alarm system for use in a stove having a burner and control device for turning the burner on and off the burner, including an audio/visual alarm device and an alarm circuit for activating the alarm device. Lipscher (U.S. Pat. No. 4,577,181) describes an alarm system for an electric range which detects when a burner is energized without a utensil in place on the burner.

Ekblad (U.S. Pat. No. 4,775,913) describes a control device for controlling the operation of an object of cooking such as a stove or the like. The presence of a user in the area of the stove is detected. When the user is present, the stove operation is enabled. Sciscoe (U.S. Pat. No. 4,866,427) describes a temperature alarm for attachment around the exterior of the flue pipe of a wood-burning or similar stove, with alarm activation temperature selected by slidable adjustment along the flue pipe. Ljunggren (U.S. Pat. No. 5,073,701) describes an arrangement in a range, a cooking hob or the like having at least one electrically heated hot plate and/or oven, comprising a manually operable setting system for the setting of a desired power or temperature for the hot plate or the oven.

McLean (U.S. Pat. No. 5,608,378) describes a fire-preventing warning system for alerting an occupant leaving the premises that a stove burner is on. Neil (U.S. Pat. No. 5,608,383) describes an automatic temperature alarm system for alerting an operator of a heated apparatus that the apparatus has been heated and untouched for an excessive period of time. Clizbe (U.S. Pat. No. 5,693,245) describes an integral electric range surface burner control switch user interface made up of two components. Vaillancourt (U.S. Pat. No. 5,717,188) describes a safety device for electric stoves and ovens. Devries (U.S. Pat. No. 5,939,992) describes a safety apparatus for electric appliances which includes a sensor for sensing that an electric appliance is operating. An alarm coupled with the sensor. Cheng (U.S. Pat. No. 5,945,017) describes an electric or gas burner that can be improved by the installation of an automated fire safety device that first determines whether the burner is being attended. Rak (U.S. Pat. No. 6,130,413) describes a safety device for use in conjunction with an electric cooking stove. Aldridge (U.S. Pat. No. 6,140,620) describes a device for disconnecting an electric appliance or a component thereof from a source of electricity. Hoellerich (U.S. Pat. No. 6,294,994) describes an attendance monitoring apparatus for an appliance, such as an electrical appliance. Klass (U.S. Pat. No. 7,002,109) describes an invention to assure the safety in use of an electric range.

SUMMARY OF THE INVENTION

According to one aspect of the invention, there is provided an appliance warning system comprising: a floor pad for location adjacent an appliance such that a user must stand on the floor pad in order to normally use the appliance; at least one switch formed in or on the floor pad, the switch being sensitive to weight pressure on the floor pad, the switch being movable between an open position when no weight pressure is detected on the floor pad and a closed position when the switch is activated by weight pressure detected on the floor pad; a control circuit in or on the floor pad and connected to the switch for determining when the switch is in the open position or the closed position, the control circuit being operational between a ready state before the switch is activated from the open position to the closed position and a monitoring state after the switch is activated to the closed position; a warning device connected to the control circuit, the warning device being activated by the control circuit when in the monitoring state when the control circuit determines that the switch has been in the open position for a preselected period of time after having been in the closed position; and a reset switch on the floor pad for resetting the control circuit from the monitoring state to the ready state.

Preferably, the floor pad is substantially rectangular and the switch and control circuit are embedded in the floor pad. In one form, the at least one switch comprises a plurality of momentary switches embedded in the floor pad.

Preferably, the control circuit restarts the preselected period of time when the switch is closed during the monitoring state. The reset switch may be located near an edge of the floor pad and is activated by the user with a foot. Further, the warning device may be selected from the group consisting of: piezo crystal, a bell, a buzzer, a speaker, a horn, a strobe light, or any combination thereof.

According to another aspect of the invention, there is provided an appliance warning system comprising: a floor pad for location adjacent an appliance such that a user must stand on the floor pad in order to normally use the appliance, the floor pad having at least one switch formed in or on the floor pad which is movable between an open position when no weight pressure is detected on the floor pad and a closed position when the switch is activated by weight pressure detected on the floor pad, and a transmitter for transmitting a signal depending upon whether the switch is in the open or closed position; a module remote from the floor pad, the module comprising a receiver for receiving the signal from the transmitter, and a control circuit connected to the receiver and operational between a ready state before the switch is activated from the open position to the closed position and a monitoring state after the switch is activated to the closed position; a warning device connected to the control circuit, the warning device being activated by the control circuit when in the monitoring state when the control circuit determines that the switch has been in the open position for a preselected period of time after having been in the closed position; and a reset switch for resetting the control circuit from the monitoring state to the ready state.

The reset switch may be located on the floor pad and/or on the module. The module may powered by an AC power source, or by a DC power source.

Preferably, the control circuit restarts the preselected period of time when the switch is closed during the monitoring state. The reset switch may be located near an edge of the floor pad and is activated by the user with a foot.

In one embodiment the module further comprises a power line carrier circuit transmitter for transmitting signals to selected devices connected to an electrical system which supplies the module with power. The power line carrier circuit may be an X-10 power line carrier which superimposes a 120 Hz coded signal over existing 60 Hz Ac wiring in the electrical system.

According to another aspect of the invention, there is provided a method of warning when an appliance remains unattended, the method comprising: placing a floor pad adjacent an appliance such that a user must stand on the floor pad in order to normally use the appliance, the floor pad having at least one switch which is sensitive to weight pressure on the floor pad, the switch being movable between an open position when no weight pressure is detected on the floor pad and a closed position when the switch is activated by weight pressure detected on the floor pad; placing a control circuit in, on or near the floor pad and connecting the control circuit to the switch in order to determine when the switch is in the open position or the closed position, the control circuit being operational between a ready state before the switch is activated from the open position to the closed position and a monitoring state after the switch is activated to the closed position; activating a warning device connected to the control circuit when the control circuit is in the monitoring state and the control circuit determines that the switch has been in the open position for a preselected period of time after having been in the closed position; and providing a reset switch on or near the floor pad for resetting the control circuit from the monitoring state to the ready state.

The module may be located remote from the floor pad and contains the control circuit and the warning device, and a transmitter is placed in the floor pad and a receiver is placed in the module to facilitate communication between the switch and the control circuit. Further, a power line carrier transmitter may be integrated into the control circuit for activating remote devices through an electrical supply system simultaneously with the warning device.

DETAILED DESCRIPTION OF THE INVENTION

Figure 1:
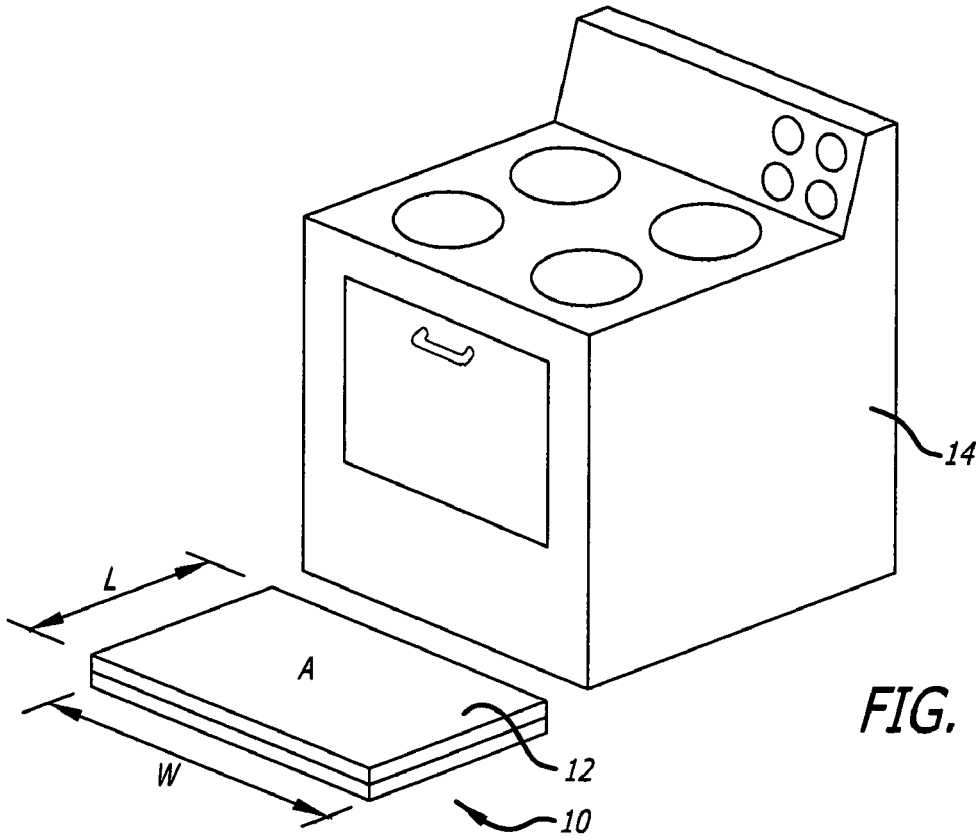
FIG. 1 is a perspective view of an appliance in the form a stove and warning device in accordance with on embodiment of the present invention.

With reference to FIG. 1 of the drawings, in one embodiment of the invention, the invention comprises a sensing device 10 including a floor pad 12. The floor pad 12 will preferably, but not necessarily, be sized and configured with dimensions approximately equivalent to the floor space typically required to use the cooking appliance 14. The floor pad 12 may be rectangular, semi-lunar, or another shape so long as a person using the cooking appliance 14 must normally stand on it in order to use the appliance 14.

Figure 2:
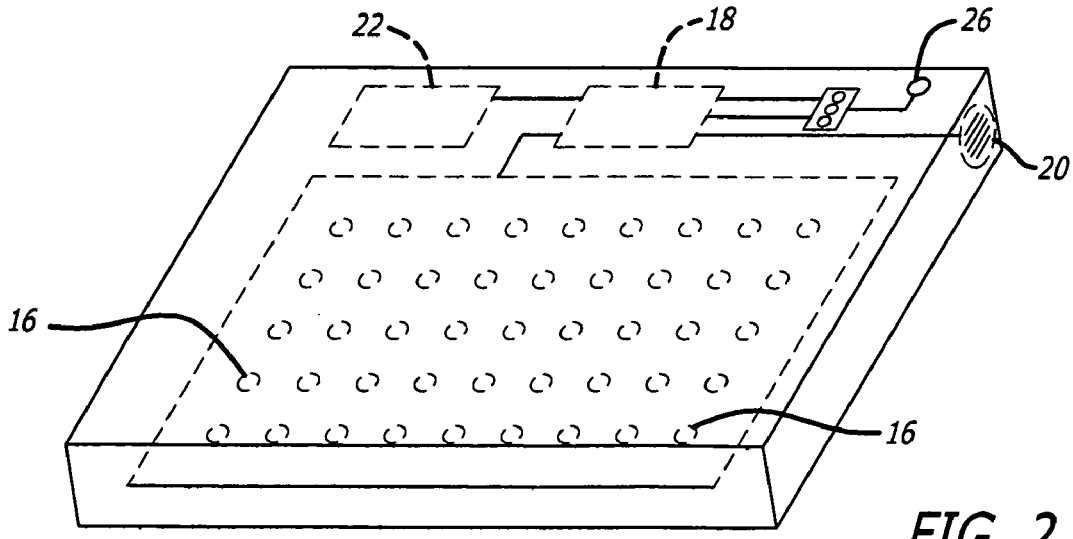
FIG. 2 is a detailed perspective view of a floor pad in accordance with the warning system of the invention.

The floor pad 12 is preferably constructed of a suitable polymeric thermoplastic, rubber, foam, gel or combination thereof so a resilient, shock absorbing surface is provided for comfort and functionality. The floor pad 12 contains a pressure sensitive, normally open, momentary switch or switches 16 (such as membrane switches) interspersed equally and imbedded within the floor pad 12 so that a person standing on the pad 12 must depresses one or more switches 16, as shown in FIG. 2 of the drawings. Any suitable arrangement incorporating electronic, electro mechanical, mechanical or electro-optical methods may be employed to configure a weight sensitive switch 16 that is momentary and normally open. The weight required to depress and momentarily close a switch 16, or signal the presence of a load on the floor pad 12, would fall within a range equivalent to the average human weight range, for example, 75 to 300 lbs.

Once a switch 16 of the floor pad 12 is depressed and thereby closed, an internal (within the floor pad 12) or external (outside the floor pad 12) populated printed circuit board or PCB (see FIG. 2) is triggered or activated by an appropriate signal form the floor pad 12 switches 16. The PCB 18 contains a circuit that monitors the open or closed condition of the floor pad 12 switch 16, a timing circuit, a power status circuit, a ON-OFF-READY indicating circuit, an alarm or signaling circuit and an electronically connected alarm or signaling device 20, such as, for example, a piezo crystal, a bell, a buzzer, a speaker, a horn, a strobe light, an RF interface to other appliances, lights, and/or a power line carrier interface to other appliances.

A power supply unit 22 is provided. The electromotive force or power supply from the power supply unit 22 required to power the PCB 18 may be comprised of a replaceable dry cell battery, rechargeable battery, AC transformer or other suitable power source.

In one embodiment of the invention as shown in FIGS. 1 and 2 of the drawings, the floor pad 12 switch or switches 16, PCB 18, power supply 22), and alarm 20 are completely self contained or embedded within the floor pad 12. In this particular embodiment, a person must stand on the floor pad 12 in front of the cooking appliance 14 to initiate a cooking procedure. When the person stands on the floor pad 12, the PCB 18 immediately detects the closed condition of the floor pad 12 switches 16 due to presence of the user, and then waits for an open condition to occur when the person leaves or steps off the floor pad 12. Once the open condition is detected, a non-user interfaced, preset timing cycle, for example, 7 minutes (although any suitable time delay can be selected) is initiated. If the person returns and steps onto the floor pad 12 before the timing cycle of 7 minutes (or other preset time) are over, the timing cycle will reset and wait for the person to leave the floor pad 12 to begin another 7 minute timing period. Resetting of the timing cycle continues as long as the person keeps returning to the cooking appliance 14. Eventually, one of two conditions will occur, as detailed further below.

Condition one: In this scenario, the person returns to the cooking appliance 14 within the selected timing cycle(s) (in this example, 7 minutes) and terminates the cooking procedure. At this point, the person depresses an optionally lighted (LED) reset switch 26 which is preferably located on the external upper surface of the floor pad 12 at a position which would not normally be stood upon by the person using the device so as to avoid inadvertent activation of the reset switch 26. Depression of the reset switch 26 on the floor pad 12 deactivates the PCB 18 and resets the system to a READY state. In the READY state, the PCB 18 will remain inactive until the next closed position of the floor pad 12 switches 16 is detected, and a new cooking procedure is initiated. If the person terminates the cooking procedure but forgets to depress the floor pad 12 reset switch 26, an internal alarm 20 will sound after the 7 minute timing cycle expires. The alarm 20 will continue to sound until the person returns to the floor pad 12 (and hence the cooking appliance 14) and resets the system to the READY state.

Condition two: In this scenario, the person does not return to the cooking appliance 14 during the first or subsequent timing cycle(s) within the preset time (7 minutes in the present example, but reprogrammable as required). In this case the internal alarm 20 will sound until the person returns to the cooking appliance 14 and steps onto the floor pad 12 to either continue the cooking procedure and initiate a further 7 minute countdown period, or terminate the cooking procedure by pressing down on the reset switch 26. If neither of these events occur, the alarm 20 will continue to sound until the floor pad 12 reset switch 26 is depressed or the power available from the power supply unit 22 (5) is depleted.

Figure 3:
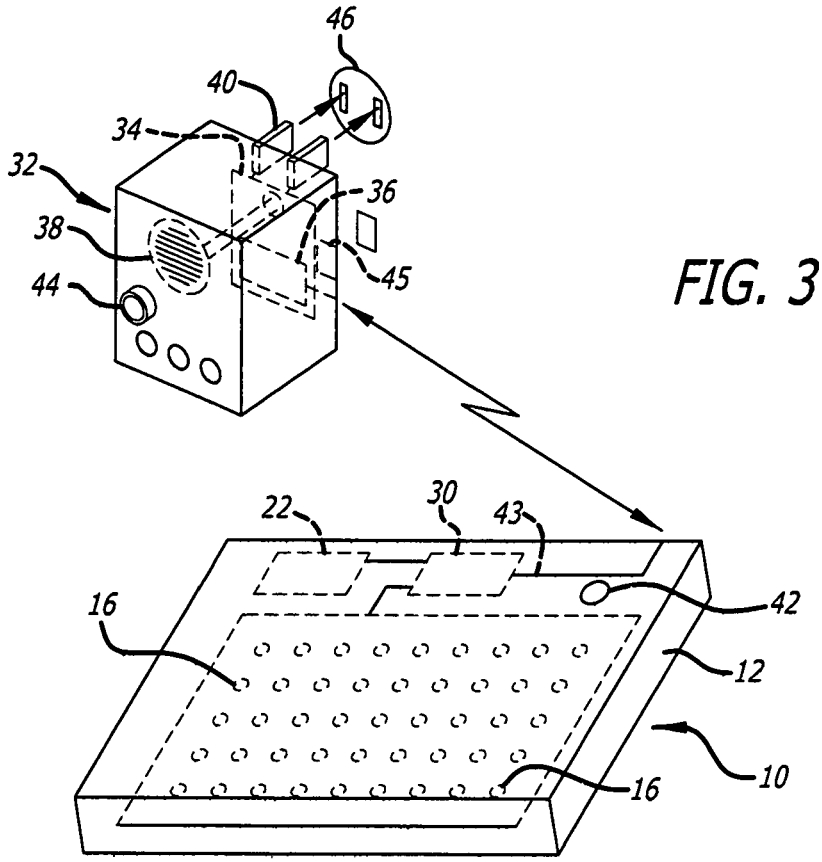
FIG. 3 is a perspective view of a floor pad and module box on the warning system in accordance with another embodiment of the present invention.

Reference is now made to FIG. 3 of the drawings which illustrates a further embodiment of the present invention. In this embodiment of this invention, all the electrical components are not self-contained within the floor pad 12. Instead, the floor pad 12 contains the pressure switch or switches 16 or other electronic, electro mechanical, mechanical or electro-optical means for detecting a weight load on the pad, a power supply unit 22, and an RF transmitter circuit 30. The power supply unit 22 powers the RF transmitter 30 contained within the floor pad 12. There are several ways for electronically configuring the RF circuit 30 that utilize standard, semi-custom and custom electronic components, such as ICs, resistors, capacitors, inductors, and so forth. An RF circuit 30 capable of propagating a discrete, pulsed and coded electromagnetic signal is preferred in the context of this invention.

The open and closed position of the floor pad 12 switches 16 are detected, processed and modulated by a circuit that is continuous with the RF transmitter circuit 30. The modulated RF signal relays the closed or open position of the floor pad 12 switches 16 to a module 32 that is plugged into a nearby (i.e. in the kitchen if the appliance being monitored is the cooking appliance 14)) electrical outlet. The module 32 houses a PCB 34 that includes: an RF receiver circuit 36 capable of detecting and decoding the modulated RF signal of the RF transmitter 30, a logic circuit, a timing circuit, an alarm or signaling circuit, a power status circuit, a ON-OFF-READY circuit, a reset circuit and a electronically connected internal module alarm 38, such as a piezo crystal, a bell, a buzzer, a speaker, a horn, a strobe light, and others, or a combination of such alarms. The PCB 34 is powered by the AC line 40.

The floor pad 12 may include a transmitting antenna 43 and the module 32 may contain a receiving antenna 45.

Operation of the apparatus is generally the same as the embodiment discussed above, except that the PCB 34 is external to the floor pad 12 and is remotely connected to the floor pad 12 through the RF transmission, namely the RF transmitter circuit 30 and the RF receiving circuit 36. This embodiment has certain advantages, some of which include: (1) the PCB 34 and the alarm 38 or signaling device are AC powered and less susceptible to power failure, and (2) a higher decibel alarm or more powerful alarm may be used since power drain, as from a dry cell battery, is a negligible factor. The floor pad 12 may have a reset switch 42 which may be located on the floor pad 12 (as in the first embodiment described above), or the rest switch 44 may be located on the outside face of module 32 that is plugged into an outlet 46 near the cooking appliance 14. Indeed, there may be both reset switches 42 and 44 within a given system in order to give the user the option of selecting one of these switches depending upon which of them may be more convenient to use in a given situation.

Figure 4:
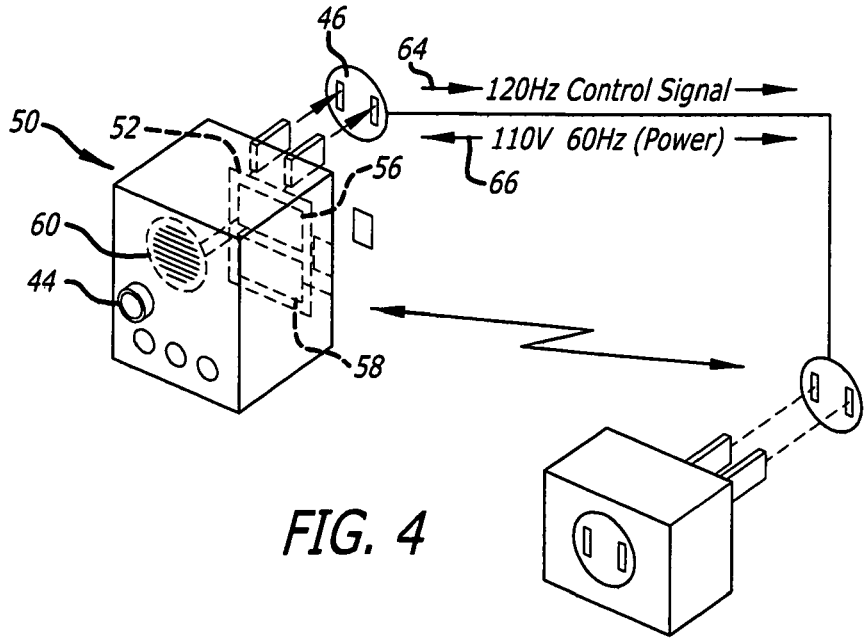
FIG. 4 is a detailed perspective view of a module of the warning system in accordance with the present invention.

Reference is now made to FIG. 4 of the drawings which shows a further embodiment of the invention. In this embodiment, the module 50 is very similar to the module 32 shown in FIG. 3 of the drawings in that it also contains the PC board 52 and internal alarm or signaling circuit. Further, the operation is essentially the same as in the embodiment illustrated in FIG. 2, but further includes an X-10 power line carrier (PLC) circuit 56, or a similar type of circuit capable of achieving substantially the same effect, that is able to superimpose a 120 Hz coded signal 64 over the existing 60 Hz AC wiring system 66 throughout the home or building. The superimposed signal can then control a variety of devices and appliances that are connected to the X-10 compatible receiver modules plugged into wall outlets throughout the house. Examples of devices that may be plugged into an X-10 compatible receiver module include: room lamps, strobe lights, PC controllers, high-decibel sounding devices, telephone dialers, existing light switches and receptacles, existing alarm systems, other appliances, and the like.

One advantage of the embodiment incorporating the X-10 compatible receiver, or a functional equivalent thereof, may be illustrated by the following example: A person initiates a cooking process and of necessity steps on and off the floor pad 12 depressing the imbedded floor pad switches 16. The closed or open condition of the floor pad 12 switches 16 is converted to a signal by a circuit that is continuous with the RF transmitter circuit located within the floor pad 12. The processed coded signal is then modulated and propagated as an RF signal to the module 50 that is plugged into an electrical outlet 46 near the cooking appliance, preferably somewhere in the kitchen. The RF signal is then processed by the RF receiver circuit 58 located on the PC board 52 housed within module 50. The processed signal activates the timing circuit within the PC board 52 housed within module 50 and a timing cycle (for example, 7 minutes) is initiated.

When the person does not return to the cooking appliance during the first or subsequent timing cycle(s) within the preset time (optionally 7 minutes), then the internal module alarm 60 housed within module 50 begins or continues to sound until one of the following events occur:

(1) the person returns to the cooking appliance, steps onto the mat and continues the cooking process, thereby resetting the timer to an additional 7 minutes;

(2) the person returns to the cooking appliance to terminate the cooking process and then depresses the floor pad reset switch 42 or module reset switch 44 to reset the system;

(3) the person returns to the cooking appliance to terminate the cooking process but forgets to reset the system by depressing the floor pad reset switch 42 or module reset switch 46, in which event the internal module alarm 60 will sound until the floor reset switch 42 or module reset switch 46 is depressed;

(4) the person fails to return to the cooking appliance, for example, after 3 timing cycles or 21 minutes. If the person has not returned to the cooking appliance or kitchen area to reset the system within 21 minutes the module 50 will activate one or more X-10 connected devices (i.e. room lamps, strobe lights, a PC controller, a high-decibel alarm, a bell, a siren, a horn, transceivers X-10 to RF and RF to X-10, a telephone dialer, etc.) to further alert the person or alert others such as neighbors, relatives, 911 emergency services, the fire department, as examples) of a potentially dangerous and life threatening situation. The use of X-10 or X-10 compatible interfaces becomes useful for persons having disabilities such as deafness. A bypass switch located on the module 50 may serve to bypass the audible alarm in favor of an X-10 device connected to a strobe light or multiple room lights to alert a deaf person in all signaling and alarm modes.

X-10 technology: X10 Power Line Carrier (PLC) technology was invented and patented in the late 1970s and opened up a whole new world of remotely controlling almost anything plugged into the electrical power line, without adding any control wiring. Basically, the X10 power line signaling technique consists of superimposing and transmitting a 120 khz coded signal on the 60 hz electrical power line. Using X10 transmitting device(s), the signal is sent over the power line to X10 receiving device(s) which are programmed with the same House and Unit code. There are 256 different standard X10 codes available (16 House codes: A through P, and 16 Unit codes: 1-16).

The invention claimed is:

1. An appliance warning system comprising:

a floor pad for location adjacent an appliance such that a user must stand on the floor pad in order to normally use the appliance;

at least one switch formed in or on the floor pad, the switch being sensitive to weight pressure on the floor pad, the switch being movable between an open position when no weight pressure is detected on the floor pad and a closed position when the switch is activated by weight pressure detected on the floor pad;

a control circuit in or on the floor pad and connected to the switch for determining when the switch is in the open position or the closed position, the control circuit being operational between a ready state before the switch is activated from the open position to the closed position and a monitoring state after the switch is activated to the closed position;

a warning device connected to the control circuit, the warning device being activated by the control circuit when in the monitoring state when the control circuit determines that the switch has been in the open position for a preselected period of time after having been in the closed position; and a reset switch on the floor pad for resetting the control circuit from the monitoring state to the ready state.

2. An appliance warning system as claimed in claim 1 wherein the floor pad is substantially rectangular and the switch and control circuit are embedded in the floor pad.

3. An appliance warning system as claimed in claim 1 wherein the at least one switch comprises a plurality of momentary switches embedded in the floor pad.

4. An appliance warning system as claimed in claim 1 wherein the control circuit restarts the preselected period of time when the switch is closed during the monitoring state.

5. An appliance warning system as claimed in claim 1 wherein the reset switch is located near an edge of the floor pad and is activated by the user with a foot.

6. An appliance warning system as claimed in claim 1 wherein the warning device is selected from the group consisting of: piezo crystal, a bell, a buzzer, a speaker, a horn, a strobe light, or any combination thereof.

7. An appliance warning system comprising:

a floor pad for location adjacent an appliance such that a user must stand on the floor pad in order to normally use the appliance, the floor pad having at least one switch formed in or on the floor pad which is movable between an open position when no weight pressure is detected on the floor pad and a closed position when the switch is activated by weight pressure detected on the floor pad, and a transmitter for transmitting a signal depending upon whether the switch is in the open or closed position;

a module remote from the floor pad, the module comprising a receiver for receiving the signal from the transmitter, and a control circuit connected to the receiver and operational between a ready state before the switch is activated from the open position to the closed position and a monitoring state after the switch is activated to the closed position;

a warning device connected to the control circuit, the warning device being activated by the control circuit when in the monitoring state when the control circuit determines that the switch has been in the open position for a preselected period of time after having been in the closed position; and a reset switch for resetting the control circuit from the monitoring state to the ready state.

8. An appliance warning system as claimed in claim 7 wherein the reset switch is located on the floor pad.

9. An appliance warning system as claimed in claim 8 wherein the reset switch is located on the module.

10. An appliance warning system as claimed in claim 8 wherein the module is powered by an AC power source.

11. An appliance warning system as claimed in claim 8 wherein the module is powered by a DC power source.

12. An appliance warning system as claimed in claim 8 wherein the module has display indicator lights thereon for indicating the status of the appliance warning system.

13. An appliance warning system as claimed in claim 8 wherein the control circuit restarts the preselected period of time when the switch is closed during the monitoring state.

14. An appliance warning system as claimed in claim 8 wherein the reset switch is located near an edge of the floor pad and is activated by the user with a foot.

15. An appliance warning system as claimed in claim 8 wherein the warning device is selected from the group consisting of: piezo crystal, a bell, a buzzer, a speaker, a horn, a strobe light, or any combination thereof.

16. An appliance warning system as claimed in claim 8 wherein the module further comprises a power line carrier circuit transmitter for transmitting signals to selected devices connected to an electrical system which supplies the module with power.

17. An appliance warning system as claimed in claim 14 wherein the power line carrier circuit is an X-10 power line carrier which superimposes a 120 Hz coded signal over existing 60 Hz Ac wiring in the electrical system.

18. A method of warning when an appliance remains unattended, the method comprising:

placing a floor pad adjacent an appliance such that a user must stand on the floor pad in order to normally use the appliance, the floor pad having at least one switch which is sensitive to weight pressure on the floor pad, the switch being movable between an open position when no weight pressure is detected on the floor pad and a closed position when the switch is activated by weight pressure detected on the floor pad;

placing a control circuit in, on or near the floor pad and connecting the control circuit to the switch in order to determine when the switch is in the open position or the closed position, the control circuit being operational between a ready state before the switch is activated from the open position to the closed position and a monitoring state after the switch is activated to the closed position;

activating a warning device connected to the control circuit when the control circuit is in the monitoring state and the control circuit determines that the switch has been in the open position for a preselected period of time after having been in the closed position; and providing a reset switch on or near the floor pad for resetting the control circuit from the monitoring state to the ready state.

19. A method as claimed in claim 18 wherein a module is located remote from the floor pad and contains the control circuit and the warning device, and a transmitter is placed in the floor pad and a receiver is placed in the module to facilitate communication between the switch and the control circuit.

20. A method as claimed in claim 18 wherein a power line carrier transmitter is integrated into the control circuit for activating remote devices through an electrical supply system simultaneously with the warning device.

* * * * *